US009469931B2

(12) United States Patent
Anderson et al.

(10) Patent No.: US 9,469,931 B2
(45) **Date of Patent: *Oct. 18, 2016**

(54) LAUNDRY TREATING APPLIANCE DOOR WITH PLANAR WINDOW ELEMENT AND BAFFLE FOR CONTROLLING LAUNDRY MOVEMENT

(75) Inventors: Colin T. Anderson, Granger, IN (US); Michael K. Lindquist, Saint Joseph, MI (US); Shannon F. Pipik, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 980 days.

This patent is subject to a terminal disclaimer.

(21) Appl. No.: 13/549,841

(22) Filed: Jul. 16, 2012

(65) Prior Publication Data

US 2013/0160501 A1 Jun. 27, 2013

Related U.S. Application Data

(63) Continuation-in-part of application No. 13/332,754, filed on Dec. 21, 2011.

(51) Int. Cl.
*D06F 37/28* (2006.01)
*D06F 37/06* (2006.01)

(52) U.S. Cl.
CPC ..... *D06F 37/28* (2013.01); *D06F 37/06* (2013.01)

(58) Field of Classification Search
CPC ..... D06F 37/28
See application file for complete search history.

(56) References Cited

U.S. PATENT DOCUMENTS

| | | | | |
|---|---|---|---|---|
| 3,276,229 | A * | 10/1966 | Deiss | 68/139 |
| 7,320,186 | B2 | 1/2008 | Schone | |
| 7,549,305 | B2 | 6/2009 | Yun et al. | |
| 7,614,162 | B2 | 11/2009 | Renzo | |
| 8,875,416 | B2 * | 11/2014 | Anderson et al. | 34/603 |
| 2007/0022788 | A1 | 2/2007 | Choi et al. | |
| 2007/0240456 | A1 * | 10/2007 | Byun et al. | 68/17 R |
| 2011/0025178 | A1 * | 2/2011 | Schone | 312/228 |

FOREIGN PATENT DOCUMENTS

| | | | |
|---|---|---|---|
| DE | 102009044711 | B3 | 4/2011 |
| DE | 202011103868 | U1 | 9/2011 |
| EP | 2312040 | A1 | 4/2011 |
| GB | 2029862 | A | 3/1980 |
| WO | 2008044133 | A1 | 4/2008 |

OTHER PUBLICATIONS

German Search Report for DE102012110179, Jul. 2, 2013.
German Search Report for DE102012109972, Jun. 26, 2013.

* cited by examiner

*Primary Examiner* — Michael Barr
*Assistant Examiner* — Jason Riggleman

(57) ABSTRACT

A laundry treating appliance may include a tub and a rotatable drum defining a first access opening to the drum, a cabinet including a front wall having a second access opening aligned with the first access opening, a bellows extending between the front wall and the tub to form a fluid seal between the first and second access openings, and the bellows having a compliance portion to accommodate relative movement between the tub and the front wall, and a door movably mounted to the front wall having a planar window element and a projection extending from the planar window element, the projection having at least a portion overlying the compliance portion to retard an item of laundry from entering the compliance portion during rotation of the drum.

17 Claims, 5 Drawing Sheets

LAUNDRY TREATING APPLIANCE DOOR WITH PLANAR WINDOW ELEMENT AND BAFFLE FOR CONTROLLING LAUNDRY MOVEMENT

CROSS-REFERENCE TO RELATED APPLICATION

This application is a continuation-in-part of U.S. patent application Ser. No. 13/332,754, filed Dec. 21, 2011, which is incorporated herein by reference in its entirety.

BACKGROUND

Laundry treating appliances, such as front-loading, horizontal axis clothes washers, typically have doors for accessing the treating chamber at least partially formed by a rotating drum. Such doors may include a cast glass window to enable observation of a laundry load as the appliance is operated. In order to maintain the moving laundry load away from the door and within the treating chamber, the window may be cast with a convex or "bubble" shape extending away from the inner face of the door and somewhat into the treating chamber when the door is closed. The thick, cast glass is typically expensive to manufacture, heavy, and occupies a substantial portion of the treating chamber that could otherwise be used for treating laundry.

SUMMARY

A laundry treating appliance may include a tub and a rotatable drum defining a first access opening to the drum, a cabinet including a front wall having a second access opening aligned with the first access opening, a bellows extending between the front wall and the tub to form a fluid seal between the first and second access openings, and the bellows having a compliance portion to accommodate relative movement between the tub and the front wall, and a door movably mounted to the front wall having a planar window element and a projection extending from the planar window element, the projection having at least a portion overlying the compliance portion to retard an item of laundry from entering the compliance portion during rotation of the drum.

DESCRIPTION OF EMBODIMENTS OF THE INVENTION

Figure 1:
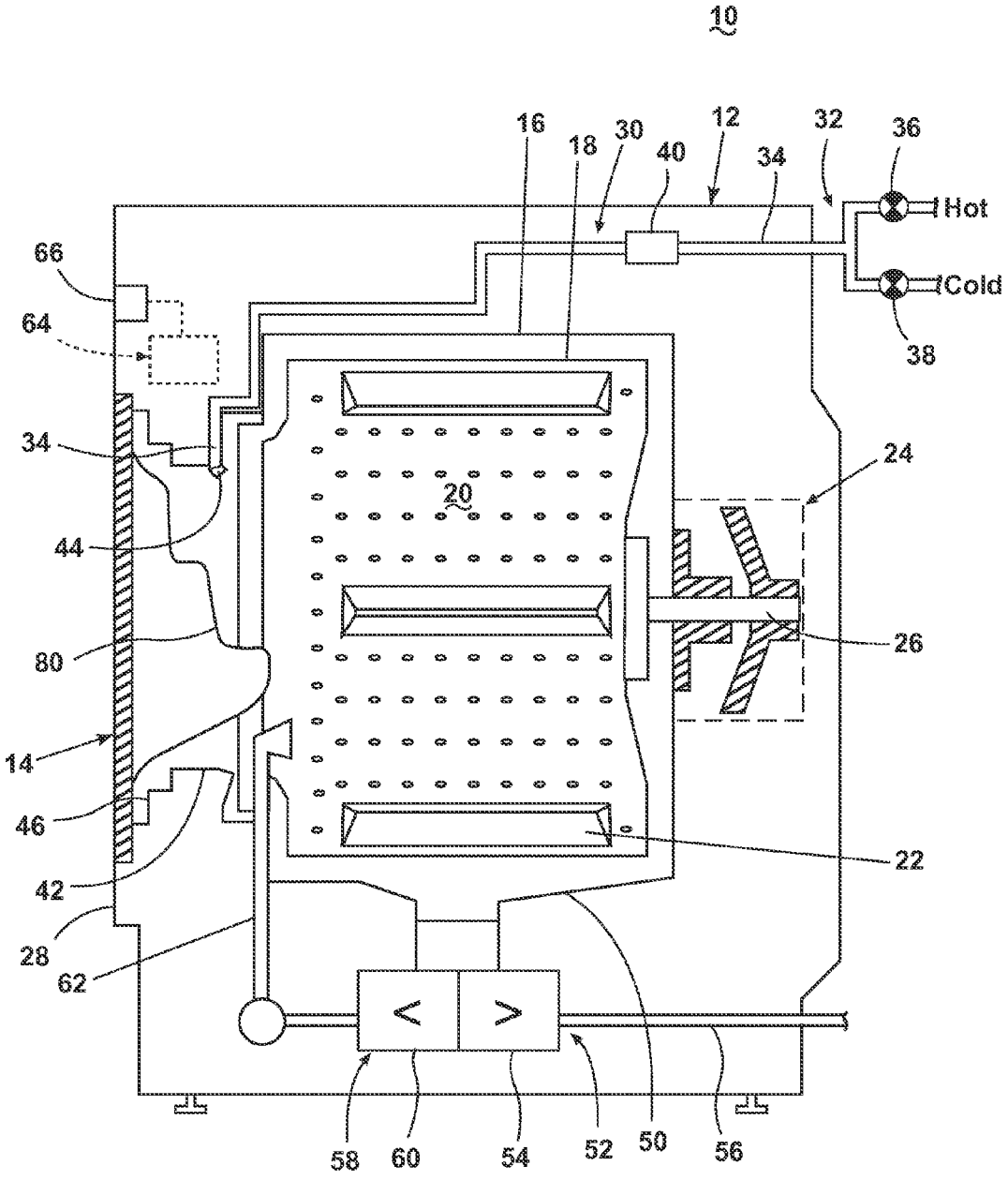
FIG. 1 is a schematic view of a laundry treating appliance in the form of a clothes washer having an exemplary door mounting a single planar glass piece and an exemplary adjoining baffle according to one embodiment of the invention.

FIG. 1 is a schematic view of a laundry treating appliance in the form of a clothes washer 10 according to an embodiment of the invention. While the laundry treating appliance is illustrated as a horizontal axis clothes washer 10, the laundry treating appliance according to the invention may be any appliance which performs a cycle of operation on laundry, non-limiting examples of which include a vertical axis clothes washer, a combination washing machine and dryer, a tumbling or stationary refreshing/revitalizing machine, an extractor, a non-aqueous washing apparatus, and a revitalizing machine. The clothes washer 10 described herein shares many features of a traditional automatic clothes washer, which will not be described in detail except as necessary for a complete understanding of the invention. Although much of the remainder of this application will focus on the embodiment of an automatic clothes washer 10, the invention may have utility in other environments, including other cleaning appliances.

The clothes washer 10 may include a cabinet 12, which may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

A door 14 may be mounted to the cabinet 12 to selectively close an access opening to the interior of a liquid-holding, imperforate tub 16. The door 14 may be provided with a baffle 80, as hereinafter described in greater detail, and as described in U.S. patent application Ser. No. 13/332,754, filed Dec. 21, 2011, entitled "Door Wash Aid Dispenser For A Laundry Treating Appliance," which is fully incorporated by reference herein. The tub 16 may be supported within the cabinet 12 by a suitable suspension system (not shown). A drum 18 may be provided within the tub 16 and may have an inner periphery at least partially defining a treating chamber 20 with an open face for receiving fabric, such as laundry to be treated according to a cycle of operation. The drum 18 may be mounted for rotation within the tub 16 and may have perforations that permit the flow of liquid between the drum 18 and the tub 16.

The tub 16 and drum 18 may have aligned openings, which provide access to the treating chamber 20. The door 14 may be provided to selectively close at least one of the aligned openings to selectively provide access to the treating chamber 20 through the open face of the treating chamber 20. While the illustrated washing machine 10 includes both the tub 16 and the drum 18, with the drum 18 defining the treating chamber 20, it is within the scope of the invention for the clothes washer 10 to include only one receptacle, with the receptacle defining the treating chamber 20 for receiving the laundry load to be treated.

At least one lifter 22 may be provided in the drum 18 to facilitate movement of the laundry load within the drum 18 as the drum 18 rotates. The lifter 22 may be provided on the inner periphery of the drum 18. Multiple lifters 22 may be provided and may optionally be evenly spaced about the inner periphery of the drum 18.

The drum 18 may be coupled with a motor 24 through a drive shaft 26 for selective rotation of the drum 18 during a cycle of operation. It may also be within the scope of the invention for the motor 24 to be coupled with the drive shaft 26 through a drive belt for selective rotation of the drum 18. The motor 24 may rotate the drum 18 at multiple or variable speeds and in one direction or opposite rotational directions.

A liquid supply system 30 may also be included in the clothes washer 10 to supply liquid to the treating chamber 20. More specifically, liquid, such as water, may be supplied from a liquid source 32, such as a household water supply, to the clothes washer 10 by operation of at least one control valve controlling the flow of water through a supply or inlet conduit 34. As shown herein, separate valves 36, 38 may control the supply of hot and cold water, respectively, through the inlet conduit 34. A flow meter 40 may be positioned in the inlet conduit 34 and may have any suitable output representative of the flow of water through it. The inlet conduit 34 may direct the water from the liquid source 32 to the treating chamber 20, and as an example, the inlet conduit 34 may direct the water into the drum 18. As shown, the inlet conduit 34 may be coupled with a bellows 42.

The bellows 42 may couple the open face of the tub 16 with a front wall 28 of the cabinet 12, and the door 14 may seal against the bellows 42 when the door 14 closes against the cabinet 12. The bellows 42 may be configured with a compliance portion 46, which is illustrated as a fold, that may deform to facilitate relative movement of the tub 16 and the front wall 28, and sealing of the closed door 14 against the bellows 42. The open face of the treating chamber 20 may coincide with an open face defined by the bellows 42 where the bellows 42 meets the cabinet 12.

The inlet conduit 34 may comprise a liquid dispenser in the form of a supply nozzle 44, for example, configured to supply the water into the treating chamber 20 along a flow path in a desired pattern and under a predetermined amount of pressure. For example, the supply nozzle 44 may be configured to supply a stream of water into the treating chamber 20 by gravity, i.e., a non-pressurized stream. The supply nozzle 44 may be mounted to the bellows 42 and be located in any desired position around the open face of the treating chamber 20. As an example, the supply nozzle 44 may be located at an uppermost position of the treating chamber 20, which would correspond to about the 12 o'clock position on the drum 18, to supply the liquid in a flow path generally downward toward the lowermost position of the treating chamber 20, which would correspond to about the 6 o'clock position on the drum 18.

Liquid in the treating chamber 20 may flow by gravity to a low portion or sump 50 of the tub 16. A liquid drain system 52 may be provided for draining liquid from the treating chamber 20. The liquid drain system 52 may include a drain pump 54 and a drain conduit 56. The drain pump 54 fluidly couples the sump 50 to the drain conduit 56 such that liquid in the tub 16 may be drained via the drain conduit 56. The drain conduit 56 may be coupled with a household drain.

An optional liquid recirculation system 58 may be provided for recirculating liquid to the treating chamber 20. As illustrated, the recirculation system 58 includes a recirculation pump 60 and a spray conduit 62. The recirculation pump 60 may fluidly couple the tub 16 to the spray conduit 62 such that liquid in the tub 16 may be supplied to the spray conduit 62, where it may be sprayed into the treating chamber 20. The recirculation pump 60 may be fluidly coupled to the sump 50 of the tub 16. The spray conduit 62 may direct the liquid from the recirculation pump 60 into the drum 18 in any suitable manner, such as by spraying, dripping, or providing a steady flow of the liquid. While the clothes washer 10 is illustrated as having separate drain and recirculation pumps 54, 60, in an alternative embodiment, the clothes washer 10 may include a single pump configured to selectively drain or recirculate liquid, such as by configuring the pump to rotate in opposite directions, or by providing a suitable valve system.

The clothes washer 10 may further include one or more devices for heating the liquid, such as a steam generator and/or a sump heater (not shown). The steam generator may be provided to supply steam to the treating chamber 20. The sump heater may be used to heat liquid in the sump 50. Alternatively, the sump heater may be used to heat laundry (not shown), air, the drum 18, or liquid in the tub 16 to generate steam, in place of or in addition to the steam generator. The steam generator may be used to heat the laundry as part of a cycle of operation, much in the same manner as sump heater, as well as to introduce steam to treat the laundry.

A controller 64 may be located within the cabinet 12 for controlling the operation of the clothes washer to implement one or more cycles of operation, which may be stored in a memory of the controller 64. Examples, without limitation, of cycles of operation include: wash, heavy duty wash, delicate wash, quick wash, refresh, rinse only, and timed wash. A user interface 66 operably coupled to the controller 64 may also be included on the cabinet 12 and may include one or more knobs, switches, displays, and the like for communicating with the user, such as to receive input and provide output. The user may enter many different types of information, including, without limitation, cycle selection and cycle parameters, such as cycle options. During operation of the clothes washer 10, the controller 64 may be operably coupled with one or more components of the clothes washer 10 for communicating with and controlling the operation of the component to complete a cycle of operation. For example, the controller 64 may be operably coupled with at least the motor 24, the valves 36, 38, the flow meter 40, the drain pump 54, and the recirculation pump 60 to control the operation of these and other components to implement one or more of the cycles of operation.

Figure 2:
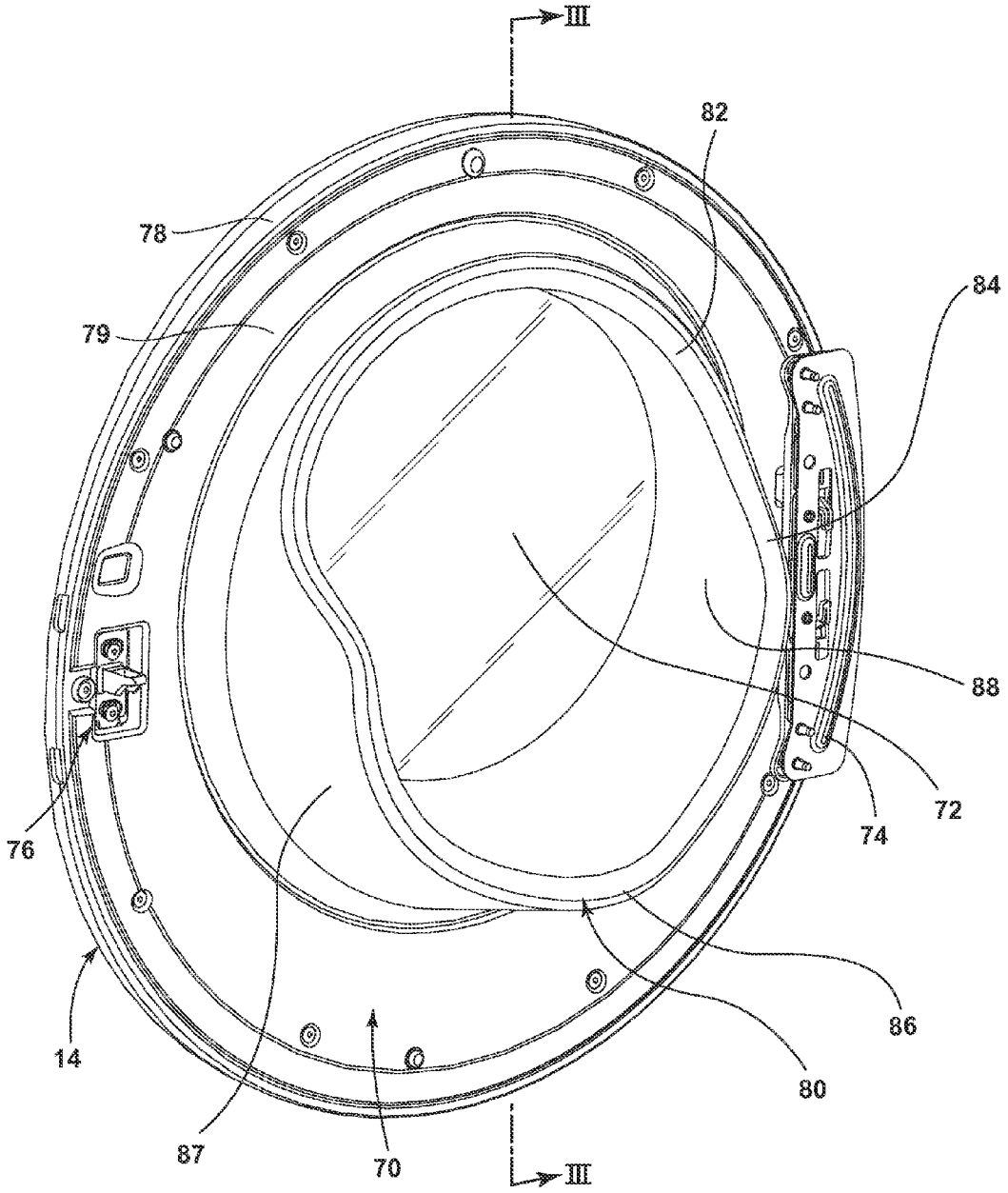
FIG. 2 is a rear perspective view of the door illustrated in FIG. 1.

Referring now to the rear perspective view of the exemplary door 14 and adjoining baffle 80 in FIG. 2, the door 14 may include a frame 70 surrounding a window 72. The frame 70 is illustrated in the present embodiment as generally circular to accommodate a corresponding structure (not shown) on the cabinet 12, but it may be understood that the frame 70 may be any suitable shape, such as elliptical, octagonal, or generally rectangular to cover most or all of the front of the cabinet 12. The frame 70 may be configured on one side with a hinge mount 74 that may receive a hinge assembly for movably mounting the door 14 to the cabinet 12, and may support a latch 76 on the opposite side for securing the door 14 to the cabinet 12 in the closed position.

The frame 70 may be a single element, or may be a composite including an outer trim element 78 and an inner trim element 79 joined together to form the frame 70. The trim elements 78, 79 may be permanently joined, such as by welding, adhesives, and the like, or joined to enable disassembly of the frame 70 by suitable removable fasteners, such as threaded fasteners, interference fit and press fit fasteners, and the like. The frame 70 may be provided with one or more handles (not shown), including recesses formed in the outer trim element 78 or exterior portion of the frame 70, for grasping by a user to open and close the door 14.

The window 72 may be generally flat or planar, and substantially translucent or transparent so that a user may view the interior of the treating chamber 20 when the door 14 is closed. In an alternative embodiment, the window 72 may be omitted or opaque. Further, the window 72 may be circular in shape, as illustrated for exemplary purposes, corresponding with the circular shape of the frame 70. Nevertheless, it is within the scope of the invention for the window 72 to have any suitable areal shape consistent with the shape of the door 14.

The baffle 80 may include a generally annular or "ring-like" wall, and may be associated with a rear side of the door 14, i.e., the side of the door 14 that faces the treating chamber 20 when the door 14 is closed. The open center of the baffle 80 may be disposed relative to the window 72 to enable viewing through the window 72 and the open center of the baffle 80. The baffle 80 may extend from the window 72 toward the treating chamber 20 and may be mounted to the window 72. Alternatively, the baffle 80 may be mounted to the frame 70, to both the frame 70 and the window 72, or may be integrally formed with the frame 70 or with the window 72. The baffle 80 may be sized for receipt within the open face of the bellows 42, as will be discussed in more detail below.

Figure 3:
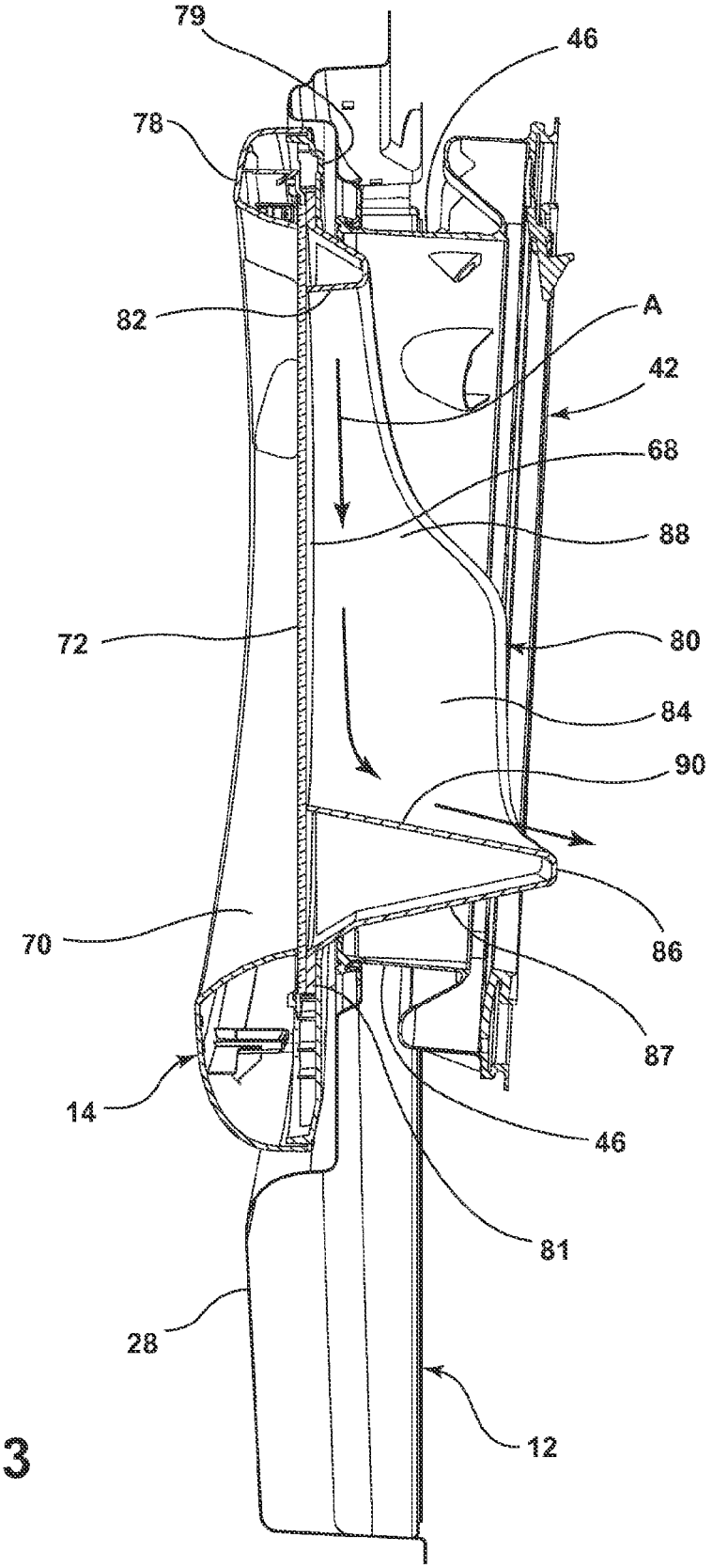
FIG. 3 is a sectional view taken along view line III-III of FIG. 2.

As best seen in the sectional view of FIG. 3, the frame 70 may have an outer trim element 78 and an inner trim element 79. The baffle 80 may have a generally circular perimeter flange 81, defining a planar rear face 68, that may enable the window 72 and the baffle perimeter flange 81 to be "sandwiched" between the outer trim element 78 and the inner trim element 79 when joined together. The baffle 80 may be mounted between the outer trim element 78 and inner trim element 79 so that the planar rear face 68 abuts the window 72. This may enable the window 72 and the baffle 80 to be readily replaced, as necessary, merely by separating the trim elements 78, 79. Alternatively, the inner trim element 79 and baffle 80 may be fabricated as a single element for coupling with the outer trim element 78. With this configuration, the window 72 may be "sandwiched" therebetween.

Figure 4:
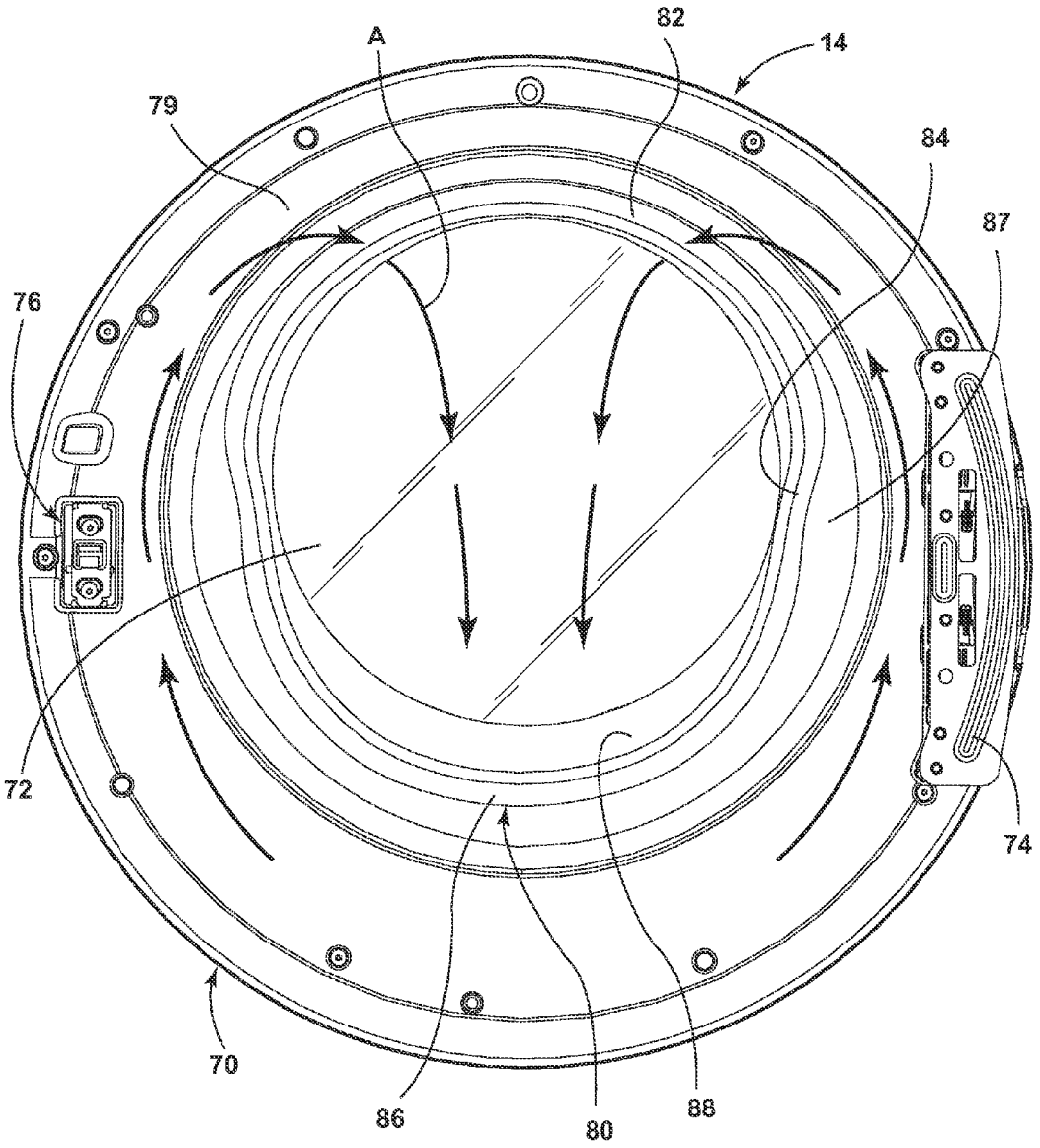
FIG. 4 is a rear elevation view of the door illustrating fluid flow paths along the door and adjoining baffle.

The baffle 80 may have a front face opposite the planar rear face 68, and having a varying depth. The baffle 80 may include distinct sections, with each section having a corresponding depth, or the depth may vary continuously around the entire baffle 80. The exemplary baffle 80 is illustrated in FIG. 4 with an upper portion 82 having a small constant depth that extends along the upper perimeter of the baffle 80, between about the "10 o'clock" and "2 o'clock" positions. The baffle 80 may also have a projection 84 at a lower portion with a greater depth such that it may project farther into the treating chamber 20. The projection 84 may extend along the lower portion of the baffle 80, between about the "3 o'clock" and "9 o'clock" positions, and may transition to a protrusion 86 having a somewhat greater depth at the lowermost portion of the baffle 80, i.e. the "6 o'clock" position. It is within the scope of the invention to have a projection 84 without the protrusion 86, or with a different configuration and depth than that illustrated in the figures.

The baffle 80 may include an outer surface 87 and an inner surface 88 having a generally planar, downwardly inclined section 90 at the projection 84, including the protrusion 86, as visible in FIG. 3. The planar section 90 may function to direct liquid and laundry items moving along the inner surface 88 of the baffle 80 toward the treating chamber 20.

As shown in FIG. 3, when the door 14 is closed, the baffle 80 may extend into the treating chamber 20 such that different parts of the baffle 80 may project different distances into the treating chamber 20, i.e. away from the window 72. In this configuration, the baffle 80, particularly the projection 84 and the protrusion 86, may overlie the compliance portion 46 of the bellows 42 and the rim of the drum 18. In order to enable movement and sealing, the compliance portion 46 may tend to deform in such a manner as to allow laundry items to enter around and behind the compliance portion 46. The extension of the baffle 80 over the compliance portion 46 and into the treating chamber 20 may prevent laundry items from becoming entrapped by the bellows 42 between the drum 18 and the door 14 or cabinet 12. Laundry items may travel downward along the window 72 to the planar section 90 to then slide over and past the bellows 42 into the treating chamber 20.

The baffle 80 may also seal against the bellows 42 by the outer surface 87 abutting the bellows 42 around the circumference of the baffle 80. The seal between the baffle 80 and the bellows 42 may inhibit the laundry from migrating through the open face of the treating chamber 20, thereby retaining the laundry load in the treating chamber 20. It may also form a fluid seal to prevent leakage of treating fluid out of the clothes washer 10 between the door 14 and the cabinet 12.

Laundry items may move along a path defined by the baffle 80 and its varying depth. As the drum 18 rotates during a cycle of operation, laundry items in the treating chamber 20 may travel upward generally circumferentially along the outer wall of the drum 18 on the lifters 22 until, at some point of rotation, the laundry items may move from the lifters 22 to the bottom of the drum 18 in a repeated tumbling action. As illustrated by the arrows labeled "A" in FIG. 4, a portion of the laundry load, and to some extent the treating liquid, may move upwardly along an exterior portion of the annular wall, i.e. the outer surface 87, to the upper portion 82 having the shallowest depth. As the laundry items slide away from the lifters 22, a portion may cross over the upper portion 82 to the inner surface 88 to fall downwardly along the window 72 and the inner surface 88 to the projection 84. The planar section 90, as a result of its downward inclination, may direct the laundry items into the treating chamber 20. As this occurs, laundry items may be inhibited from contact with the bellows 42, and possible entry into a channel or space between the cabinet 12 and the bellows 42.

Figure 5:
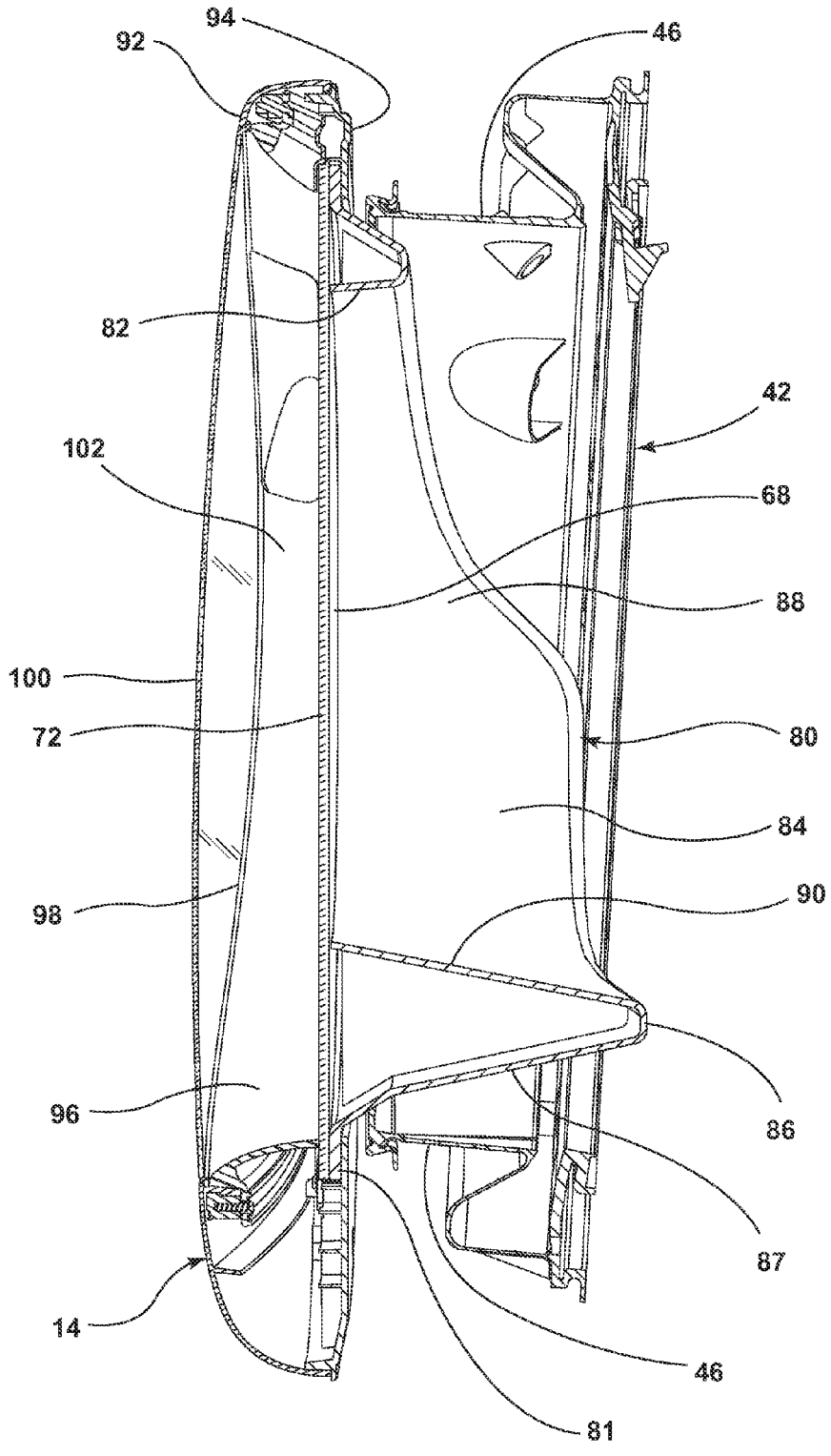
FIG. 5 is a sectional view similar to FIG. 3 of an exemplary door having a first planar glass piece adjoining the baffle and a second somewhat convex glass piece defining a front face according to a second embodiment of the invention.

Referring now to FIG. 5, a second embodiment of the invention is illustrated which may include essentially all the components of the first embodiment, with the exception of a modified frame 102 and an additional outer window 100 at an outer portion of the door 14. The outer window 100 may be generally flat or planar, and substantially translucent or transparent. Alternatively, the window 100 may be opaque, and may be convex. The frame 102 may include an outer trim element 92 and an inner trim element 94 separated by a spacer ring 96. A circumferential glass channel 98 may be provided between the outer trim element 92 and the spacer ring 96 for holding the window 100 in the frame 102. The glass channel 98 may be part of the outer trim element 92, the spacer ring 96, or both, configured so that the outer window 100 may be "sandwiched" between the outer trim element 92 and the spacer ring 96 when the outer trim element 92 and spacer ring 96 are joined together. Two or more of the outer trim element 92, inner trim element 94, and spacer ring 96 may be permanently joined, such as by welding, adhesives, and the like, or joined to enable disassembly of the frame 102 by suitable removable fasteners, such as threaded fasteners, interference fit and press fit fasteners, and the like.

Substituting a baffle and a planar glass piece for a known convex cast glass window may provide a savings in costs, since it may be less costly to mold a resin baffle and couple it with a relatively inexpensive piece of plate glass. Furthermore, the weight of the combined resin baffle and plate glass window may be less than the weight of the known convex cast glass window. Consequently, efficiency in the manufacture of the door may be optimized. Replacement of a damaged baffle and/or window may also be less costly than replacement of a convex cast glass window.

While the invention has been specifically described in connection with certain specific embodiments thereof, it may be understood that this is by way of illustration and not of limitation, and the scope of the appended claims should be construed as broadly as the prior art will permit.

What is claimed is:

1. A laundry treating appliance for treating a laundry load according to at least one cycle of operation, the appliance comprising:

a tub at least partially defining a liquid holding chamber and having a first access opening;

a rotatable drum at least partially defining a treating chamber with an open face, and located within the liquid holding chamber such that the open face is aligned with the first access opening;

a front wall having a second access opening aligned with the open face;

a bellows extending between the front wall and the tub to form a fluid seal between the first and second access openings, and the bellows having a compliance portion to accommodate relative movement between the tub and the front wall; and a door movably mounted to the front wall to selectively close the second access opening, the door having a frame defining an opening, a planar window carried by the frame and closing the opening, the planar window having a rear surface confronting and open to the treating chamber, and a projection extending from the planar window, the projection having at least a portion overlying the compliance portion of the bellows to retard an item of the laundry load from entering the compliance portion during the rotation of the drum.

2. The laundry treating appliance of claim 1 wherein the compliance portion comprises at least one channel formed in the bellows.

3. The laundry treating appliance of claim 2 wherein the at least one channel is located between the first and second access openings.

4. The laundry treating appliance of claim 3 wherein the portion of the projection extends through the open face.

5. The laundry treating appliance of claim 4 wherein the portion of the projection is located on a lower portion of the planar window.

6. The laundry treating appliance of claim 1 wherein the portion of the projection extends through the open face.

7. The laundry treating appliance of claim 1 wherein the projection defines an annular wall projecting from the planar window.

8. The laundry treating appliance of claim 7 wherein the depth of the annular wall projecting from the planar window varies from being greater at a lower portion of the projection to lesser at an upper portion of the projection to encourage items in the laundry load, which come into contact with the annular wall in response to the rotation of the drum, to travel upwardly along an exterior of the annular wall until the items reach the upper portion of the wall, where they cross over the annular wall and fall downwardly.

9. The laundry treating appliance of claim 1 wherein the planar window is vertically oriented.

10. The laundry treating appliance of claim 1 wherein the door further comprises an outer trim element and an inner trim element, which are mounted together and retain the planar window between the outer and inner trim elements.

11. The laundry treating appliance of claim 10 wherein the projection is integrally formed with the inner trim element.

12. The laundry treating appliance of claim 10 wherein the door further comprises a second window spaced from the planar window closer to an outer portion of the door than the planar window.

13. The laundry treating appliance of claim 12 wherein the door further comprises a spacer located between the second window and the planar window.

14. The laundry treating appliance of claim 12 wherein the second window is convex.

15. The laundry treating appliance of claim 14 wherein at least one of the planar window and the second window is vertically oriented.

16. The laundry treating appliance of claim 10 wherein a handle is formed in the outer trim element.

17. The laundry treating appliance of claim 16 wherein the handle comprises a recess formed in the outer trim element.

* * * * *